US006925711B2

(12) United States Patent
Kilmer et al.

(10) Patent No.: US 6,925,711 B2
(45) Date of Patent: Aug. 9, 2005

(54) MICRO-TEXTURED HEAT TRANSFER SURFACES

(75) Inventors: Raymond J. Kilmer, Lancaster, PA (US); John B. Eye, Lancaster, PA (US); Stephen F. Baumann, Lancaster, PA (US); Michael P. Danz, Lancaster, PA (US)

(73) Assignee: Alcoa Inc., Pittsburgh, PA (US)

( * ) Notice: Subject to any disclaimer, the term of this patent is extended or adjusted under 35 U.S.C. 154(b) by 0 days.

(21) Appl. No.: 10/652,754

(22) Filed: Aug. 28, 2003

(65) Prior Publication Data

US 2004/0068871 A1 Apr. 15, 2004

Related U.S. Application Data

(62) Division of application No. 09/698,854, filed on Oct. 27, 2000, now Pat. No. 6,644,388.

(51) Int. Cl.[7] ..... B23P 15/26

(52) U.S. Cl. ..... 29/890.053; 29/890.03; 29/890.04; 29/5

(58) Field of Search ..... 29/890.053, 890.03, 29/890.045; 165/133, DIG. 15, DIG. 17, DIG. 29

(56) References Cited

U.S. PATENT DOCUMENTS

| | | | | |
|---|---|---|---|---|
| 3,457,990 A | | 7/1969 | Theophilos et al. | 165/133 |
| 3,496,752 A | | 2/1970 | Kun | 165/133 |
| 3,906,604 A | | 9/1975 | Kakizaki et al. | 165/133 |
| 4,182,412 A | | 1/1980 | Shum | 165/133 |
| 4,258,783 A | | 3/1981 | Albertson et al. | 165/133 |
| 4,434,846 A | | 3/1984 | Lu | 165/161 |
| 4,846,267 A | | 7/1989 | Shattes et al. | 165/133 |
| 4,928,508 A | * | 5/1990 | Courval | 72/42 |
| 4,984,626 A | | 1/1991 | Esformes et al. | 165/151 |
| 5,070,937 A | | 12/1991 | Mougin et al. | 138/38 |
| 5,249,446 A | * | 10/1993 | Biresaw et al. | 72/42 |
| 5,377,746 A | | 1/1995 | Reid et al. | 165/133 |
| 5,537,851 A | | 7/1996 | Sheu et al. | 72/366.2 |
| 5,577,555 A | | 11/1996 | Hisajima et al. | 165/109.1 |
| 5,682,946 A | * | 11/1997 | Schmidt et al. | 165/133 |
| 5,975,196 A | | 11/1999 | Gaffaney et al. | 165/133 |
| 6,059,014 A | | 5/2000 | Strezov | 164/480 |
| 6,371,199 B1 | | 4/2002 | Gebhart | 165/104.21 |

FOREIGN PATENT DOCUMENTS

| | | | |
|---|---|---|---|
| EP | 0 037 854 | 12/1980 | F28F/1/42 |
| EP | 0 733 871 | 9/1996 | F28F/1/40 |
| EP | 0 753 709 | 1/1997 | F28B/39/00 |
| EP | 0 819 908 | 1/1998 | F28F/1/10 |
| JP | 02-61497 | 2/1990 | F28F/1/32 |
| JP | 05-10696 | 1/1993 | F28F/1/40 |

* cited by examiner

*Primary Examiner*—David P. Bryant
*Assistant Examiner*—Stephen Kenny
(74) *Attorney, Agent, or Firm*—D. Mark Maloney; Eckert Seamans Cherin & Mellott, LLC

(57) ABSTRACT

A wrought aluminum sheet product having a textured surface for improved heat transfer properties. A plurality of textured features having dimensions of about 1–50 microns is roll textured onto one or both sides of the sheet. The aluminum sheet may be used as the fins or tubing of a heat exchanger.

7 Claims, 3 Drawing Sheets

MICRO-TEXTURED HEAT TRANSFER SURFACES

CROSS REFERENCE TO RELATED APPLICATIONS

This application is a division of U.S. application Ser. No. 09/698,854, filed Oct. 27, 2000, now U.S. Pat. No. 6,644,388 entitled "Micro-Textured Heat Transfer Surfaces".

FIELD OF THE INVENTION

The present invention relates to textured heat transfer surfaces. More particularly, the present invention relates to finstock which is micro-textured to provide increased surface area and increased turbulence of air flowing thereover, and to tubestock, turbulators and the like which are micro-textured to provide increased surface area and increased coolant or refrigerant flow thereover.

BACKGROUND OF THE INVENTION

Aluminum and its alloys are particularly useful materials for heat exchangers in a variety of applications including vehicles such as cars, trucks, airplanes, and the like. Aluminum alloys are lighter than steel alloys and thus offer weight advantages in many applications in vehicles. The light weight and excellent heat transfer properties of aluminum alloys make them particularly attractive candidates for use in heat exchangers such as radiators, heaters, evaporators, oil coolers, condensers and the like. These heat exchangers and similar components are typically fabricated from mill finished brazing sheet which may be clad or unclad. Conventional aluminum brazing sheet typically includes two to four roll bonded layers with at least one of the exterior layers being an Aluminum Association (AA) 4xxx series alloy and the other layers being 1xxx, 2xxx, 3xxx, 4xxx, 5xxx, 6xxx, 7xxx or 8xxx series alloy. Mill finished brazing sheet has an inherent roughness of about 0.7 micron root mean squared (RMS) or less. All dimensions referred to hereinafter include the RMS value thereof.

Aluminum brazing sheet is fabricated into the tubes of heat exchangers and the fins attached thereto. The efficiency of a heat exchanger is significantly affected by many variables including the total surface area of the heat transfer surfaces and the persistence of thermal boundary layers on the heat transfer surfaces. Hence, it is generally desirable to maximize the size of the heat transfer surface area and to turbulate the heat transfer media (coolant, air, refrigerant, etc.) to disrupt the boundary layer and maximize heat transfer.

For finstock, turbulators and the like, one approach to enhancing turbulation of the heat transfer medium has been to use louvers which are members that are mechanically flared out into the air or coolant stream, and cause re-direction (i.e. turbulation) of the air or coolant. Conventional louvers on finstock are about 0.5–2 millimeters (mm) high and are spaced apart by about 1 mm. The length of a louver typically is about 80–90 percent of the length of a fin. Other types of embossments for heat exchanger fins are disclosed in U.S. Pat. Nos. 4,434,846 and 4,984,626. Louvers and other embossments must be incorporated into heat exchanger components with due regard for the geometry of the components. Due to their size and configuration, louvers and embossments can only be used on a limited variety of heat exchanger components and at limited positions on a component.

More recently, extruded condenser tubing has been provided with small voids in the extrusion profile of the tube which increase the surface area and increase turbulation of the refrigerant flowing therein. Extruded tubing is typically only used for high pressure environments (e.g. 1000 psi) such as in condensers because of the relatively high production costs compared to wrought products and the limitations on the alloy types suitable for extrusion.

Accordingly, a need remains for wrought products having features for enhancing heat transfer which may be used in a variety of heat exchanger components.

SUMMARY OF THE INVENTION

This need is met by the wrought product of the present invention having a micro-textured surface with textured features having dimensions of about 1–50 microns high, preferably about 20–40 microns high, about 1–200 microns wide, preferably about 20–50 microns wide and spaced apart by about 1–50 microns, preferably about 20–50 microns apart. The wrought product may be an aluminum brazing sheet or finstock used in concert with brazing sheet or be formed from stainless steel or copper/brass (Cu/brass). The aluminum may be a monolithic sheet of the AA series 1xxx, 2xxx, 3xxx, 4xxx, 5xxx, 6xxx, 7xxx, or 8xxx or a multilayer composite sheet with each layer being one of the AA series 1xxx, 2xxx, 3xxx, 4xxx, 5xxx, 6xxx, 7xxx, or 8xxx. The textured features are preferably roll textured into the aluminum sheet in a regular pattern of spaced apart cross hatches, spaced apart circles, dimples, parallel lines or combinations thereof. The roll texturing can be done as a finishing step by a material supplier or on a strip as a part of the fabrication practice for a particular component being made (e.g. roll textured while in a fin machine or tube making machine). The wrought sheet is about 25–1500 microns thick.

The wrought sheet of the present invention may be used to fabricate the tubing, fins or turbulators of a heat exchanger such as a radiator, oil cooler, heater, condenser, evaporator or the like. The textured aluminum surface may be present on one or both sides of the fins of a heat exchanger or on the surfaces of the heat exchanger exposed to the coolant and/or refrigerant (e.g. the internal surface of a radiator or heater tube).

BRIEF DESCRIPTION OF THE DRAWINGS

Other features of the present invention will be further described in the following related description of the preferred embodiments which is to be considered together with the accompanying drawings wherein like figures refer to like parts and further wherein.

DESCRIPTION OF THE PREFERRED EMBODIMENTS

Figure 1:
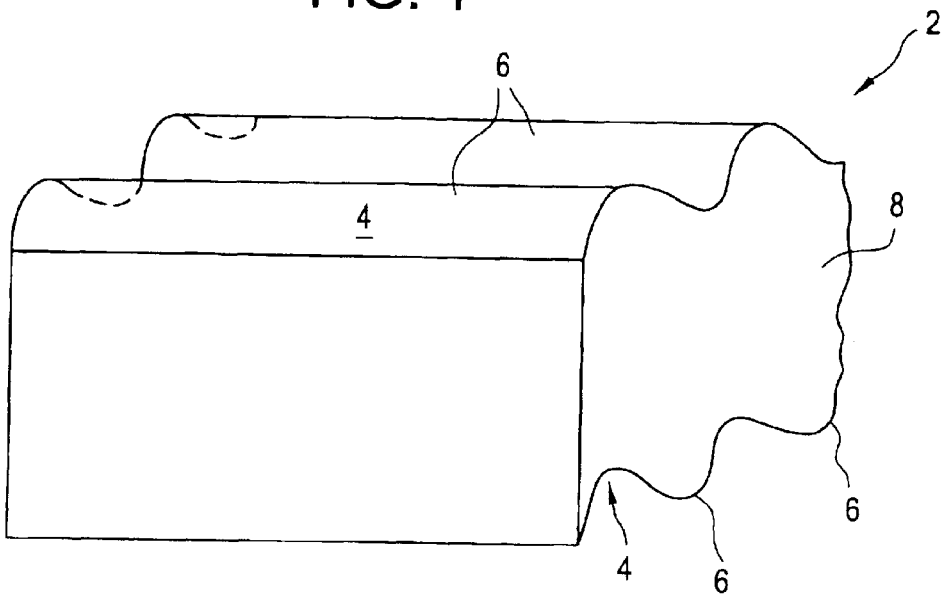
FIG. 1 is a perspective view of a sheet having textured features made in accordance with the present invention.

For purposes of the description hereinafter, the terms "upper", "lower", "right", "left", "vertical", "horizontal", "top", "bottom" and derivatives thereof relate to the invention as it is oriented in the drawing figures. However, it is to be understood that the invention may assume various alternative variations and step sequences, except where expressly specified to the contrary. It is also to be understood that the specific devices and processes illustrated in the attached drawings, and described in the following specification, are simply exemplary embodiments of the invention. Hence, specific dimensions and other physical characteristics related to the embodiments disclosed herein are not to be considered as limiting.

The present invention includes a wrought product including textured sheet 2 shown in FIG. 1 and heat exchangers incorporating the sheet 2. In a particularly preferred embodiment, the sheet 2 is produced from mill finished aluminum brazing sheet. The sheet 2 may be a monolithic sheet of the AA series 1xxx, 2xxx, 3xxx, 4xxx, 5xxx, 6xxx, 7xxx, or 8xxx or a multilayer composite sheet with each layer being one of the AA series 1xxx, 2xxx, 3xxx, 4xxx, 5xxx, 6xxx, 7xxx, or 8xxx. Other aluminum alloys not registered with the Aluminum Association may also used in the present invention. Mill finished aluminum brazing sheet typically has a maximum roughness of about 0.7 micron. The sheet may be produced from other materials such as stainless steel and Cu/brass.

The sheet 2 has a textured surface 4 on one or both sides thereof in the form of micro-textured features 6 extending from a main body 8 of the sheet 2. By the term micro-textured, it is meant texturing which imparts features to the sheet having dimensions larger than the inherent roughness of the sheet yet smaller than conventional embossments in finstock. The texturing may or may not reduce the gauge of the sheet 2. In certain cases, the overall thickness of the sheet 2 is reduced despite the presence of the textured features 6 extending from the main body 8 of the sheet 2. However, it is also possible for the overall thickness of the sheet 2 (measured from peak to peak on opposing sides of the sheet 2) to increase as a result of creating relatively large textured features 6.

The textured features 6 are preferably produced by creating a negative image of a desired pattern onto the surface of a roll and running the mill finished sheet through a set of rolls set at a gap height less than the thickness of the incoming sheet. One or both of the rolls may be patterned depending on whether one or both sides of the wrought product are to be micro-textured. The height of the textured features 6 is influenced by the amount of reduction of the incoming sheet, determined by a roll separating force (e.g. up to about 9500 psi), taken during the rolling pass. Increases to the roll separating force serves to increase the degree of relief on the surface up to some maximum roll separating force. Beyond this maximum roll separating force, a degradation of the pattern may be observed. As such, there is a critical range of roll separating force that must be established for a particular pattern on a sheet of a particular alloy with particular mechanical properties. The negative pattern on the rolls may be created by use of lasers or by a photo-resist and etch method or any other technique (such as sandblasting or electron discharge machining (EDM)) for reproducibly and precisely removing small and exact bits of the hardened roll into the desired negative pattern.

Figure 2:
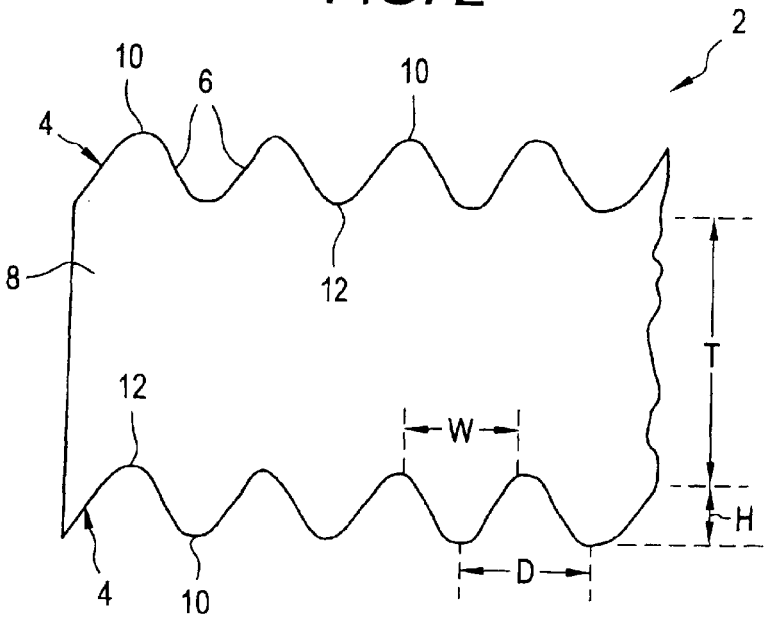
FIG. 2 is a side view of the sheet shown in FIG. 1.
Figure 3:
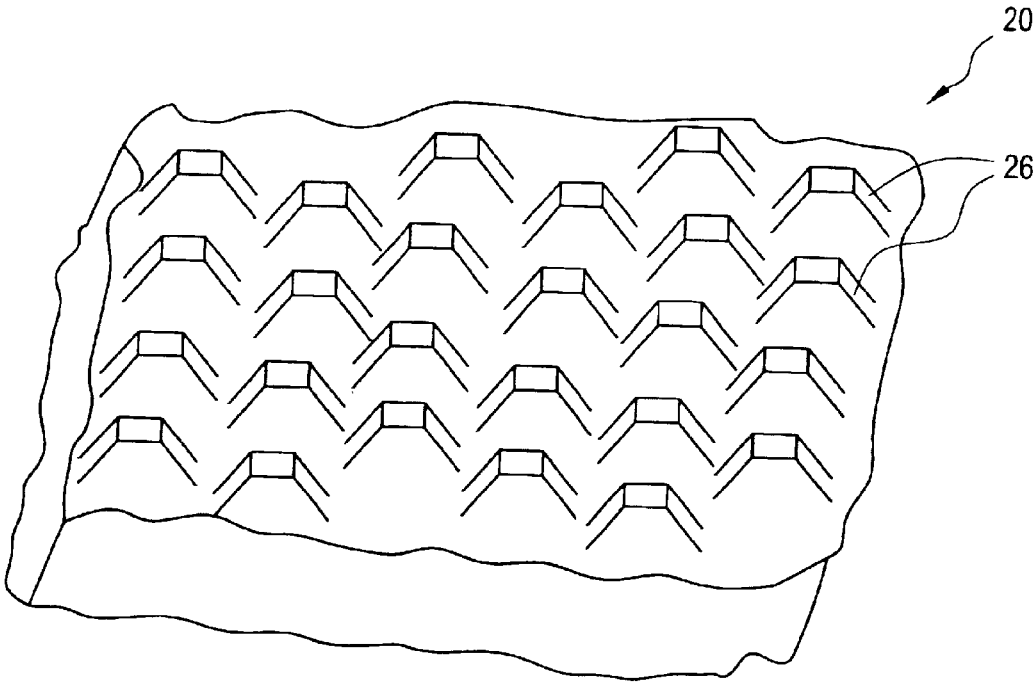
FIG. 3 is a perspective view of a sheet having another type of textured feature.

The textured features 6 may be present in a variation of configurations. FIGS. 1 and 2 show the textured features 6 as being parallel ridges extending across the width of the sheet 2. Other suitable configurations for the textured features 6 include spaced apart circles, annuli, grooves, dimples or cross hatches distributed across the textured surface 4. The spacing between the textured features 6 may be regular or irregular across the sheet 2. FIG. 3 shows a sheet 20 having pyramid-shaped textured features 26 positioned at regular intervals across one side of the sheet 20. The pattern of the textured features 6 is determined by the pattern present on the texturing roll. The textured features 6 and 26 shown in FIGS. 1–3 are depicted as being of symmetrical form and spaced evenly apart. This is not meant to be limiting as the textured features may also be non-symmetrical and/or irregularly spaced and may vary in form from textured feature to textured feature across a sheet.

Mill finished brazing sheet typically has a thickness of about 25–1500 microns with a maximum height of any roughness feature of about 0.7 micron. Referring to FIGS. 1 and 2, the thickness T of the main body 8 of the sheet remains nearly the same as the original thickness of the mill finished sheet less the amount of reduction thereof as result of the roll texturing. The distance H between a peak 10 of the textured features 6 and the main body 8 of the sheet 2 is preferably about 1–50 microns, more preferably about 20–40 microns. For relatively smooth mill finished sheet, the textured features 6 may be as small as 1 micron high. For rougher mill finished sheet, the minimum height of the textured features 6 may be 2–5 microns. The width W of the base of the peaks 10 is preferably 1–200 microns, more preferably 20–50 microns. The distance D between the peaks 10 is preferably about 1–50 microns, more preferably 20–50 microns. Each peak 10 of a textured feature 6 is shown in FIGS. 1 and 2 on one surface 4 of the sheet 2 as opposing a valley 12 on the other surface 4 of the sheet 2. This is not meant to be limiting as the textured features 6 on the opposing side of the sheet 2 may have the same or different configuration.

The sheet 2 may be used to produce a heat exchanger such as a radiator, heater, evaporator, cooler, condenser or the like. The sheet 2 may be fabricated into the fins of a heat exchanger and/or the tube to which the fins are attached. When the sheet 2 is used as a fin, preferably both sides of the sheet 2 are micro-textured however it is also contemplated that only one side of a fin may include the textured features 6. The sheet 2 may also be made into a heat exchanger tube.

Figure 4:
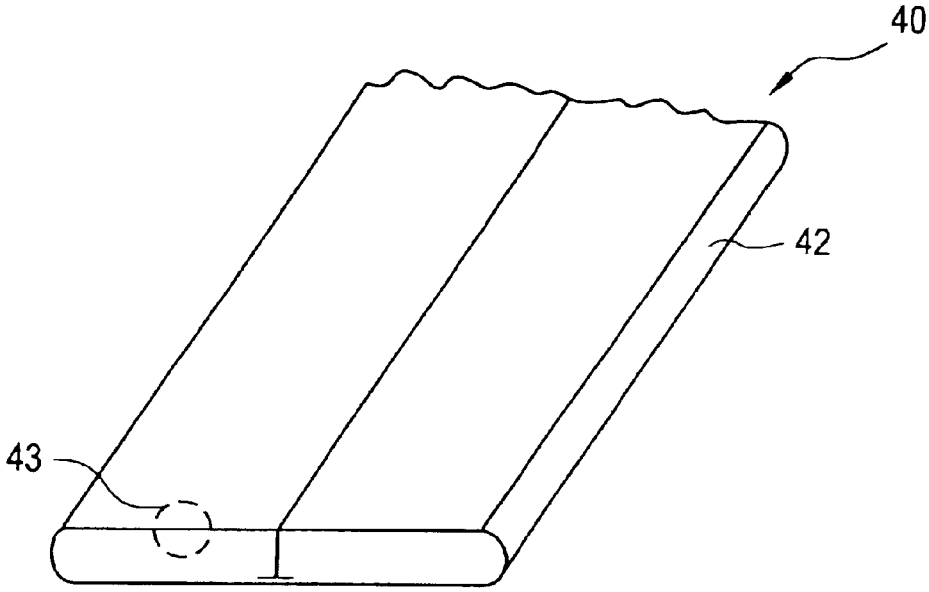
FIG. 4 is a perspective view of a folded tube type of heat exchanger tubing features made in accordance with the present invention.
Figure 5:
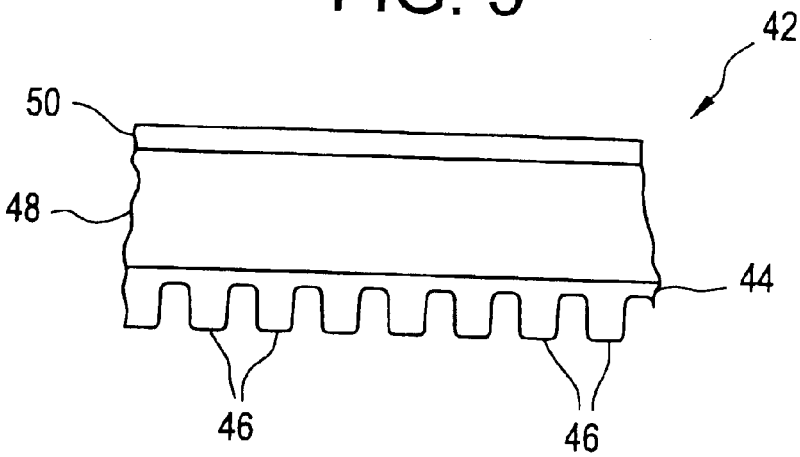
FIG. 5 is an enlarged view of a portion of the tubing shown in FIG. 5.

Heat exchanger tubing may also be micro-textured on the inside surface of the tube (the side in contact with a coolant or refrigerant) or on the exterior surface of the tube to which the fins are attached (the air side or fin side). For example, as shown in FIGS. 4 and 5, a radiator or heater tube 40 may be formed from a sheet 42 folded into the shape of tube. A portion 43 of the sheet 42 is shown enlarged in FIG. 5. The sheet 42 includes an aluminum alloy waterside liner 44 with textured features 46 rolled therein positioned on one side of an aluminum alloy main body 48 and an aluminum-silicon clad layer 50 positioned on the other side of the main body 48. It has been found that improved heat transfer properties are achieved when the coolant side of heat exchanger tubing includes the textured surface of the present invention.

The wrought metal products of the present invention are micro-textured to provide substantially higher surface areas than prior heat exchange components with morphologies that aid in increasing turbulence of heat transfer media flowing thereover. The textured features 6 are sized sufficiently fine (small) to allow for products fabricated from the textured sheet 2 to be made without concern as to the location of the textured features 6 with respect to the component geometry. Micro-textured finstock may include conventional louvers or other embossments and be fabricated in the identical manner and on the same fin machines employed for untextured finstock. As such, the incoming stock used to fabricate a part may be micro-textured without concern for the specific dimensions or part geometries. The configurations or patterns of the textured features 6 are also believed to improved other critical product features. The textured features 6 improve the directional bending moments of the product, particularly when in the form of parallel ridges as shown in FIGS. 1 and 2, and strengthen the final product. In the case of evaporators where shedding of cooling water is desired, the textured features 6 are believed to improve water management via enhanced capillary action.

It will be readily appreciated by those skilled in the art that modifications may be made to the invention without departing from the concepts disclosed in the foregoing description. Such modifications are to be considered as included within the following claims unless the claims, by their language, expressly state otherwise. Accordingly, the particular embodiments described in detail herein are illustrative only and are not limiting to the scope of the invention which is to be given the full breadth of the appended claims and any and all equivalents thereof.

What is claimed is:

1. A method of making a heat exchanger component comprising:

providing a mill finished brazing sheet having on at least one face thereof micro-textured features of from about 1 to about 50 microns in size; and forming said textured brazing sheet into a heat exchanger component, wherein at least one heat transfer surface of the heat exchanger component includes the textured features.

2. The method of claim 1 wherein the heat exchanger component is a tube.

3. The method of claim 2 wherein the beat transfer surface having the textured features is on an interior surface of the tube.

4. The method of claim 1 wherein the heat exchanger component is a fin.

5. The method of claim 1 wherein the heat exchanger component is a turbulator.

6. The method of claim 1 wherein said micro-textured brazing sheet is provided by rolling a mill finished brazing sheet between a pair of rolls, wherein at least one of the rolls has a surface bearing a negative pattern of a textured pattern to be imparted to the brazing sheet, and wherein the rolls are gapped to provide a separating force selected to create micro-textured features of a desired height on a surface of the sheet contacting said roll surface bearing said negative pattern.

7. The method of claim 1 wherein said micro-texture features have a size of from about 2 to about 5 microns.

* * * * *